US008904585B2

(12) United States Patent
Cridlebaugh

(10) Patent No.: US 8,904,585 B2
(45) Date of Patent: Dec. 9, 2014

(54) HAND-HELD IMPLEMENT FOR SCRAPING AND HAMMERING

(76) Inventor: Bryan Cridlebaugh, Lewiston, ID (US)

( * ) Notice: Subject to any disclaimer, the term of this patent is extended or adjusted under 35 U.S.C. 154(b) by 228 days.

(21) Appl. No.: 13/506,564

(22) Filed: Apr. 27, 2012

(65) Prior Publication Data

US 2013/0283541 A1 Oct. 31, 2013

(51) Int. Cl.
*B25F 1/00* (2006.01)

(52) U.S. Cl.
USPC ..... 7/144

(58) Field of Classification Search
CPC ..... B25F 1/00; B25D 1/00; A62B 3/005
USPC ..... 7/144, 158; 30/169, 172
See application file for complete search history.

(56) References Cited

U.S. PATENT DOCUMENTS

| | | | | | |
|---|---|---|---|---|---|
| 1,239,394 | A * | 9/1917 | Hovhannesian | 7/144 |
| 3,837,023 | A * | 9/1974 | Spencer-Foote | 7/145 |
| 5,020,181 | A * | 6/1991 | Leonard | 15/105 |
| 5,097,554 | A * | 3/1992 | McLaughlin | 7/105 |
| 6,266,834 | B1 * | 7/2001 | Walsh et al. | 7/144 |
| 8,113,094 | B1 * | 2/2012 | Brackbill et al. | 81/138 |
| 8,365,332 | B2 * | 2/2013 | Allen et al. | 7/166 |
| 2009/0106919 | A1 * | 4/2009 | Montgomery | 15/105 |
| 2011/0056027 | A1 * | 3/2011 | Shortt | 7/144 |
| 2011/0062400 | A1 * | 3/2011 | Lindskog | 254/104 |
| 2012/0180226 | A1 * | 7/2012 | Pedersen | 7/144 |

* cited by examiner

*Primary Examiner* — David B Thomas
(74) *Attorney, Agent, or Firm* — Wells St. John PS

(57) ABSTRACT

This invention includes embodiments which disclose a hand-held tool implement or apparatus which includes among other things, a handle attached to a head with a scraper and a hammering surface thereon.

13 Claims, 7 Drawing Sheets

HAND-HELD IMPLEMENT FOR SCRAPING AND HAMMERING

CROSS REFERENCE TO RELATED APPLICATION

This application does not claim priority from any other application.

TECHNICAL FIELD

This invention generally relates to a hand-held implement or tool apparatus which includes a scraper portion and a hammer portion, and more particularly to a hand-held tool implement or apparatus with a handle and a head which among other things includes a scraper blade and a hammering surface thereon.

BACKGROUND OF THE INVENTION

In the construction and remodeling trade, there are numerous situations in which one needs to clean and/or prepare an existing surface to apply paint or other coatings and which require that the surface be scraped for one reason or another. In some cases the scraping is to remove existing paint, glue or other material from the surface (which is typically but not always a wood based material). Scraping and preparing the surface can be a physically demanding and time consuming job and in many instances must be done while standing on a ladder, on scaffolding or otherwise off the ground.

When scraping and otherwise preparing these surfaces, such as the exterior of a building such as a house or other structure, it is common to encounter nails partially protruding out of the surface being prepared—and these nails need to either be pounded all the way into the surface or removed. Many workers such as painters who are scraping also carry with them (or keep nearby), a hammer which allows them to either pound the nail into the surface or remove it with a claw or other nail remover.

With the physical and oftentimes elevated nature of the work, it is desirable to minimize the weight of the scrapers, hammers and other tools to minimize the fatigue and make it easier to perform the scraping, cleaning and preparation tasks at hand. In many instances rough or difficult areas are encountered in which the worker needs to be able to apply additional pressure such as by using their second hand in order to remove the material in the desired way. In addition to having a primary handle for use, many scrapers have some type of secondary or additional handle to provide a way and location for the user to use a second hand to apply more scraping pressure or force and/or to better direct the scraping tool.

It is therefore an object of embodiments of this invention to provide an improved scraper which also includes an integral hammering surface.

It is also an object of embodiments of this invention to provide such a scraper and hammer wherein the scraper blade may be pulled or pushed during the scraping motion and wherein the scraper blade is oriented generally transverse to the handle.

While the invention was motivated in addressing some objectives, it is in no way so limited. The invention is only limited by the accompanying claims as literally worded, without interpretative or other limiting reference to the specification, and in accordance with the doctrine of equivalents. Other objects, features, and advantages of this invention will appear from the specification, claims, and accompanying drawings which form a part hereof. In carrying out the objects of this invention, it is to be understood that its essential features are susceptible to change in design and structural arrangement, with only one practical and preferred embodiment being illustrated in the accompanying drawings, as required.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

Figure 1:
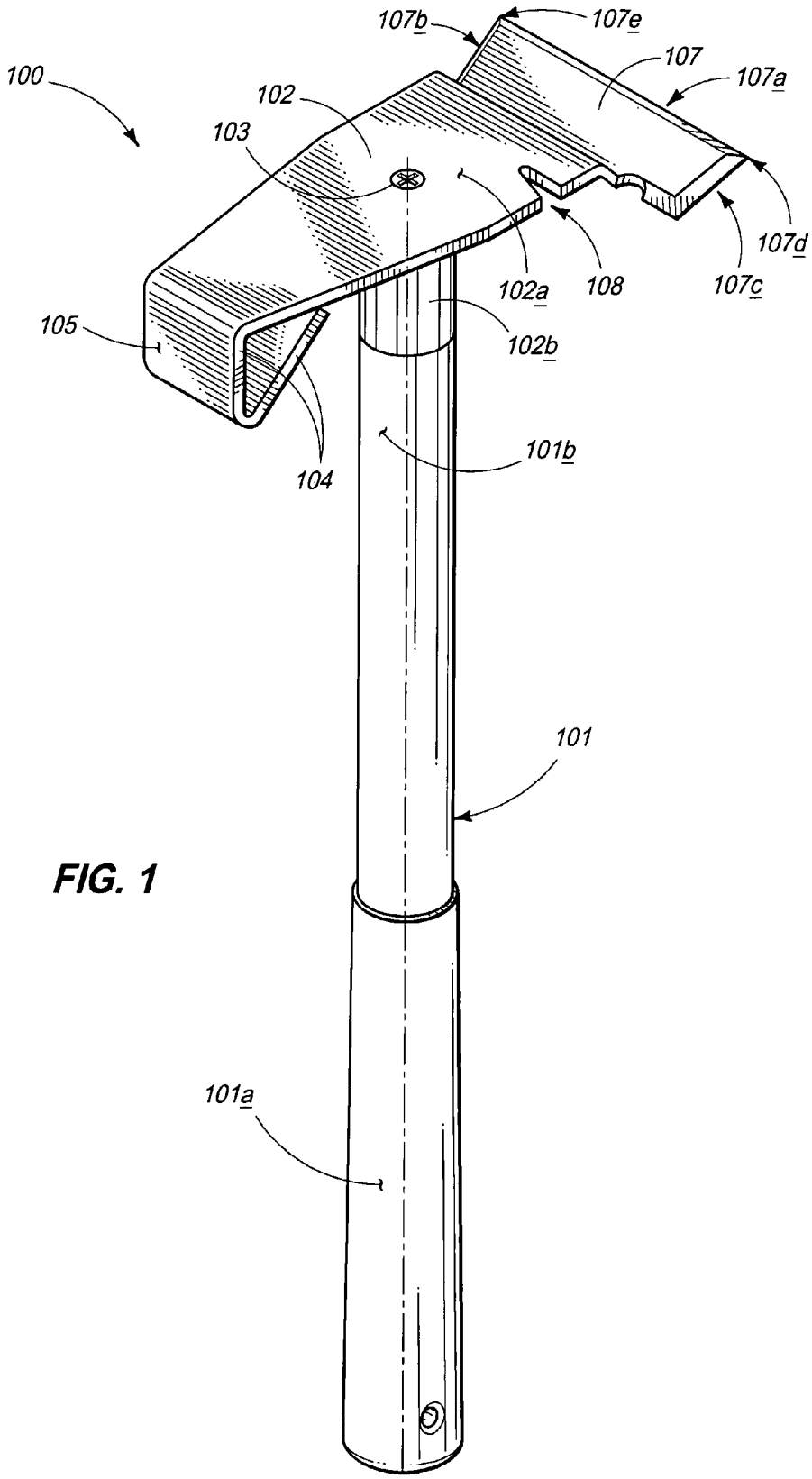
FIG. 1 is a perspective view of an example of one embodiment of the invention.

Many of the fastening, connection, manufacturing and other means and components utilized in this invention are widely known and used in the field of the invention described, and their exact nature or type is not necessary for an understanding and use of the invention by a person skilled in the art or science; therefore, they will not be discussed in significant detail. Furthermore, the various components shown or described herein for any specific application of this invention can be varied or altered as anticipated by this invention and the practice of a specific application or embodiment of any element may already be widely known or used in the art or by persons skilled in the art or science; therefore, each will not be discussed in significant detail.

The terms “a”, “an” and “the” as used in the claims herein are used in conformance with long-standing claim drafting practice and not in a limiting way. Unless specifically set forth herein, the terms a”, “an” and “the” are not limited to one of such elements, but instead mean “at least one”.

Very generally, disclosed is an improved scraper with an integral hammer to facilitate scraping paint, glue and other material from the surface, with the added utility of removing protruding nails, staples and the like. The scraping portion includes one or more scraping surfaces, which may be blades. The one or more blades are preferably on one end of the implement in some embodiments of the invention with the hammer portion of the head informed on the opposing end of the implement. Multiple nail removal apertures may be formed within or defined by the body of the head of the implement. The tool handle is attached perpendicularly to the axis of the tool body and are integral with ferrule.

The scraper portion may include one or more scraping surfaces or blades, such as a first scraping surface with a plane at approximately 90° to the handle at a terminal end of the head. The first scraping blade may have a negative rake angle of fifteen (15) to twenty-five (25) degrees—which may have several advantages such as minimizing the chatter of the head while scraping. It will be appreciated by those of ordinary skill in the art that an alternative design would allow for replaceable scraper blade to minimize the maintenance and the need to place the entire head.

The head of the implement is preferably one piece (although not required for the invention) and may be made from any one of a number of different materials, with a carbon or alloy steel with a carbon alloy content of 0.45% to 0.65%, being one example for maximum strength and preferable weld-ability. The head may but need not be heat treated, and an exemplary hardness of a Rockwell 45-55 may be utilized. One of many examples of an alternative head material may be a medium carbon martensitic stainless steel.

The handle may be attached to the head in any one of a number of different ways, such as by the exemplary welded ferrule attached to the head illustrated in the drawings (which generally illustrate a screw through the head and into the top end of the handle to secure the assembly in certain embodiments of this invention).

In the embodiment illustrated in FIG. 1, the hammer polygon shape may be formed into a rigid truss-like structure or enclosure and may further utilize welding for maximum rigidity if desired in some embodiments of the invention.

Although no particular size is required to practice this invention, the scraping and hammering implement or tool may be preferably in the ten (10) inch to eighteen (18) inch long area. Again although not required to practice this invention, the wooden handle may be press fit into the ferrule and additionally secured by a screw or other fastener through and/or between the head and the handle of the implement. While wood may be one of the preferred materials for the handle for several reasons, this invention is not limited to any particular type of material and any one of a number of different materials may be used for the handle such solid or tubular steel, plastic and others. A typical desired handle may be round, elliptical or arcuate, with no one particular geometry being required to practice this invention.

The nail removal or nail pulling portion is integrated with (or formed within) the implement body and located for easy use and maximum leverage on pulling a nail. The nail removal or puller may be a tapered aperture in the head to grip and remove a variety and range of nail types and sizes and there may be one or more of them, all within the contemplation of this invention.

It will also be appreciated by those of ordinary skill in the art that the hammer portion of the head may additionally serve as a palm rest or surface against which additional pressure my be applied to maximize the scraping force pressure (with the user's hand that is not engaged or gripping the handle).

In some examples of embodiments of this tool, it may feature three or more scraping surfaces (or blades), which may include a scraping plane at a 90° angle to axis of the head or to the handle. The figures further illustrate how in some embodiments of the invention, the first or primary scraping blade may be set at a negative rake angle (for example at a 15° to 25° angle) to minimize chatter.

FIG. 1 is a perspective view of an example of one embodiment of the invention, illustrating a combined scraper-hammer implement 100 with handle 101, lower portion 101*a* of handle 101, and upper portion 101*b*. The upper portion 101*b* of the handle 101 is secured or attached to the head 102 by in this example, inserting the upper end of handle 101 into the hosel 102*b* of the head 102.

FIG. 1 further illustrates the hammer portion 104 of the head 102 of the implement 100, including a hammer surface 105, scraper portion 107 and nail removal slot 108 (slot or aperture). The top surface 102*a* of the head 102 is shown relative to the scraper portion 107 in this figure.

In this example of this embodiment of the invention, the handle 101 may be further secured to the head 102 by fastener 103 (a screw being one example), which in this example is a screw which is driven through the top surface of head 102 and into the top end of handle 101.

FIG. 1 further illustrates a front edge 107*a* of the scraper portion 107 of the head 102, which may be a surface, edge and/or scraper blade. FIG. 1 also shows a first corner 107*d* which is shown at an approximate right angle, a first side scraper edge 107*c* and a second side scraper edge 107*b*, with second side scraper point 107*e* also being shown. It will be appreciated by those of ordinary skill in the art that the hammer portion 104, including the hammering surface 105, may be utilized as: a location to: additionally grab, direct and/or apply pressure with one's second hand while scraping.

Figure 2:
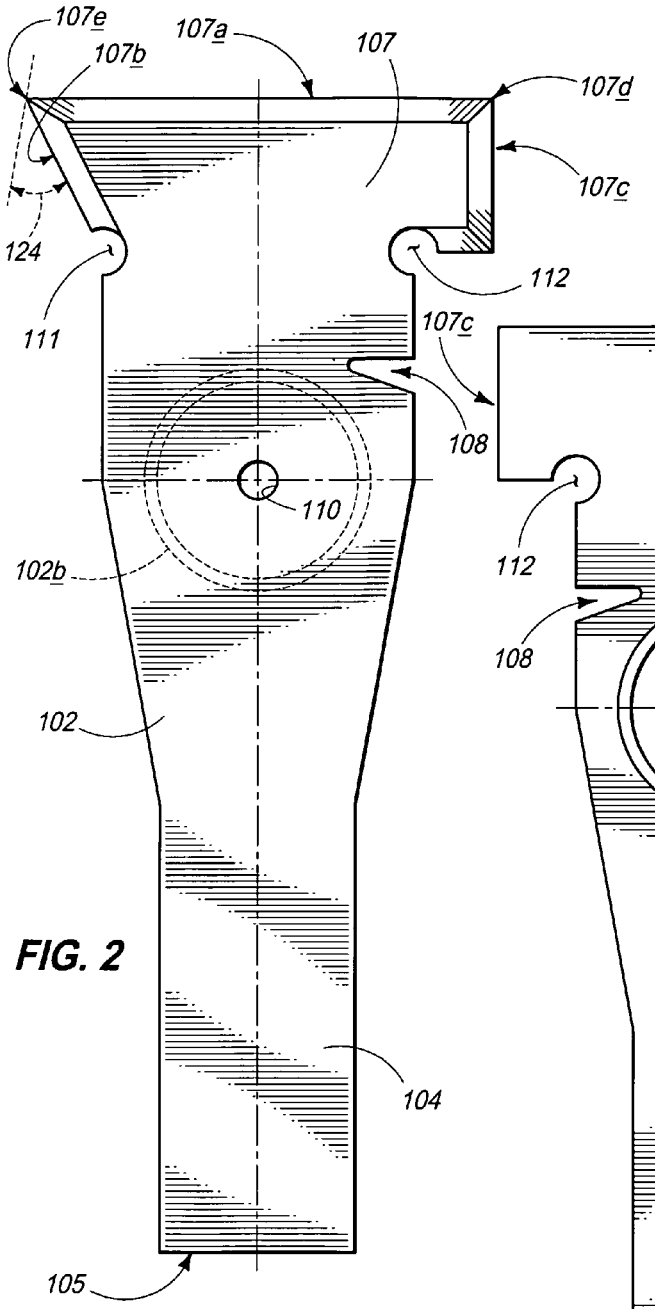
FIG. 2 is a top view of one example of a head that may be used in practicing embodiments of this invention.

FIG. 2 is a top view of one example of an implement head 102 that may be used in practicing embodiments of this invention, illustrating head 102, fastener aperture 110, hosel 102*b*, hammer surface 105 on the hammer portion 104 of the head 102. FIG. 2 further illustrates scraper points 107*d* and 107*e* on the scraper portion 107 of the head, nail removal aperture 108, arcuate slots 111 and 112. FIG. 2 further shows how angle 124 may be utilized in order to provide a desired scraper point 107*e* at a desired angle. The nail removal aperture 108 may be positioned in several different locations on the head 102, with one preferred location being on the side close to the handle as shown, to provide a desired leverage for removing nails.

It will be appreciated by those of ordinary skill in the art that although the embodiment of the scraper-hammer implement 100 shown in these figures includes a one piece head which includes both the blade or scraper portion and the hammer portion, that in other embodiments it will be desirable to utilize a replaceable blade that can be replaced with newer, sharper or differently configured blade surfaces—all within the contemplation of this invention.

Figure 3:
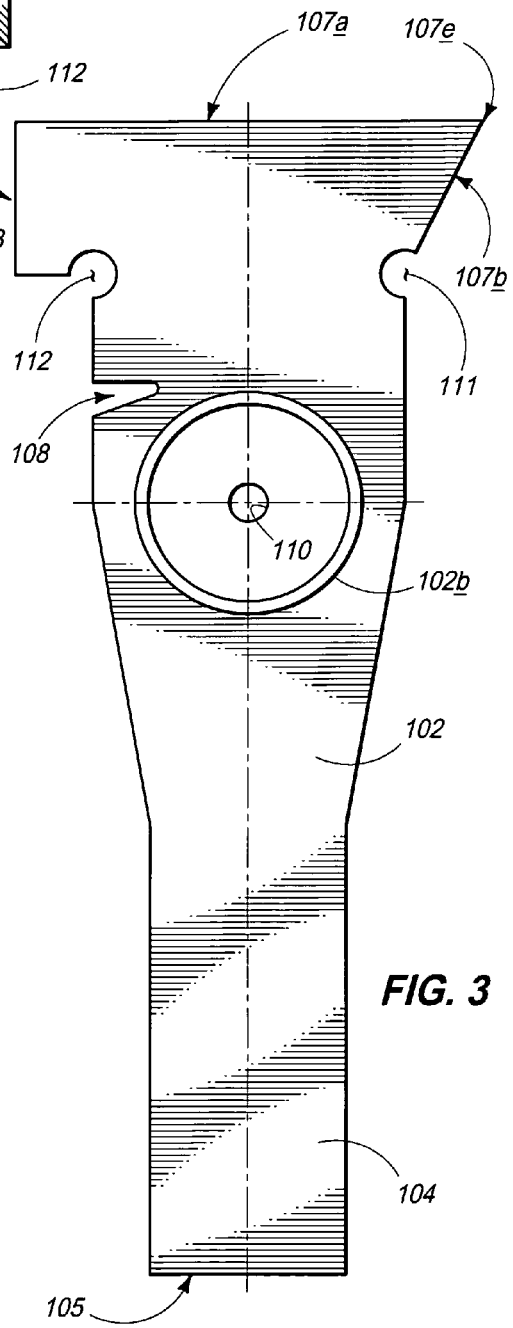
FIG. 3 is a bottom view of the example of the head illustrated in FIG. 2.

FIG. 3 is a bottom view of the example of the head illustrated in FIG. 2, illustrating the same items as shown and described in FIG. 2, and which will not be repeated herein.

Figure 4:
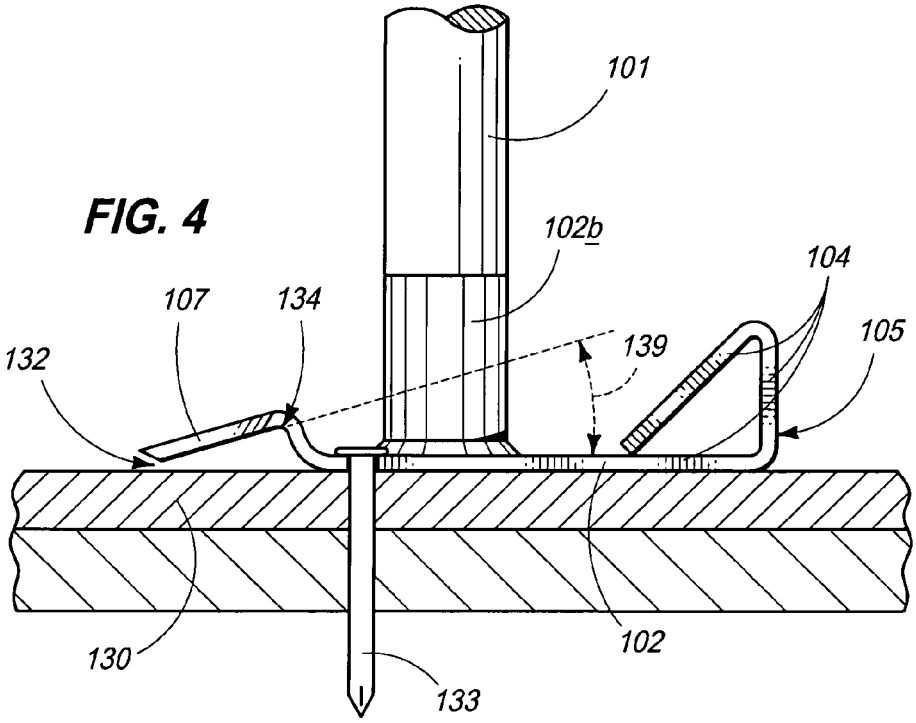
FIG. 4 is an elevation view of the example of the embodiment of the invention illustrated in FIG. 1, but in position to remove a nail.

FIG. 4 is an elevation of the example of the embodiment of the invention illustrated in FIG. 1 in position to remove a nail 133 from board 130. FIG. 4 shows handle 101 secured within hosel 102*b* of the head 102, scraper portion 107, and hammer portion 104 with hammer surface 105. FIG. 4 also shows angle 139 at which scraper portion 107 is shown in this example of this embodiment of the invention. Further shows that the end of the scraper portion 107 is offset by distance 132 within shed 102 was placed on a flat surface. This offset or gap 132 allows for the removal of nails and 33 without digging in the sharp edge of scraper portion 107.

Figure 4A:
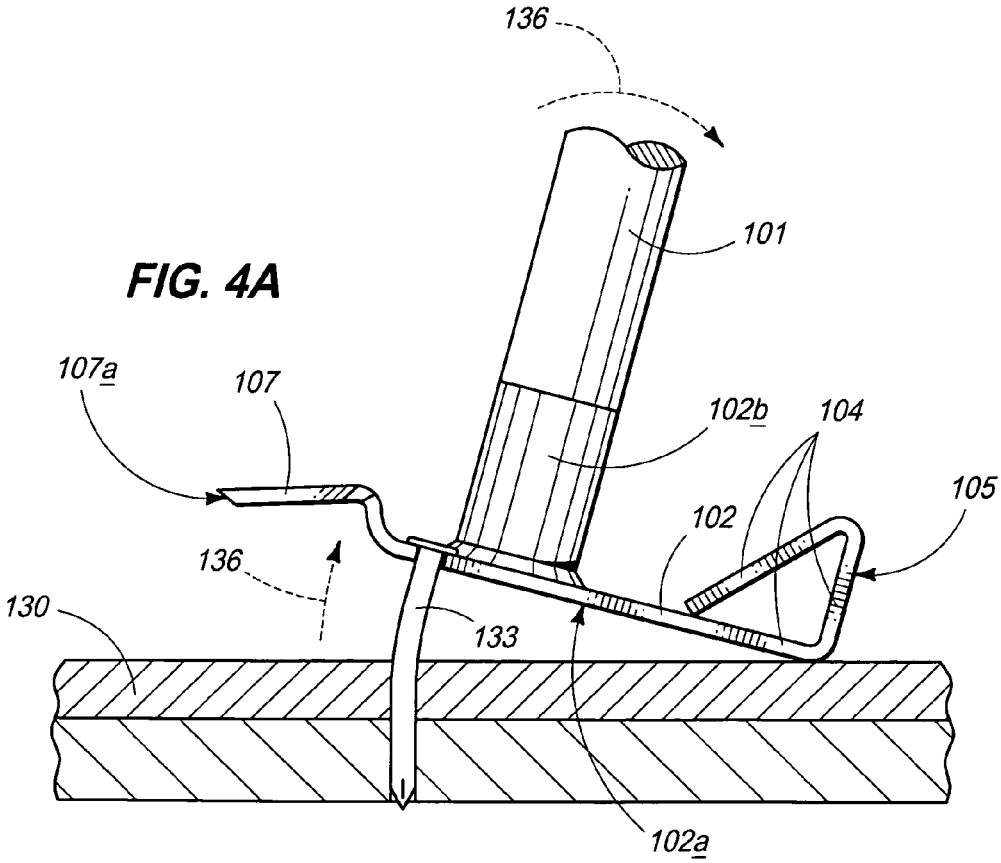
FIG. 4A is an elevation view of the example of the embodiment of the invention illustrated in FIG. 4 in second position wherein a nail is being removed.

FIG. 4A is an elevation of the example of the embodiment of the invention illustrated in FIG. 4 in second position wherein a nail is being removed. Like numbered items are the same from FIG. 4 and will not be repeated herein. FIG. 4 also illustrates scraper it should 107*a*, with arrows 136 illustrating the movement of the head 102 while removing a nail 133 using the head 102.

FIG. 4 further shows an embodiment of the invention wherein the scraper portion 107, which may also be referred to as the blade, is at an angle 139 offset from perpendicular. While there is a range of preferred angles for the blade angle 139, the angle shown in FIG. 4 has proven to be effective during use. It can also be seen that in addition to the blade body 107 being at blade angle 139, the blade portion 107 is partially defined by being cut at an angle relative to itself as further illustrated in FIG. 5 by blade edge angle 150. This combination of blade angle 139 (shown in FIG. 4) and the blade edge angle 150, provides a preferred configuration for typical scraping.

Figure 5:
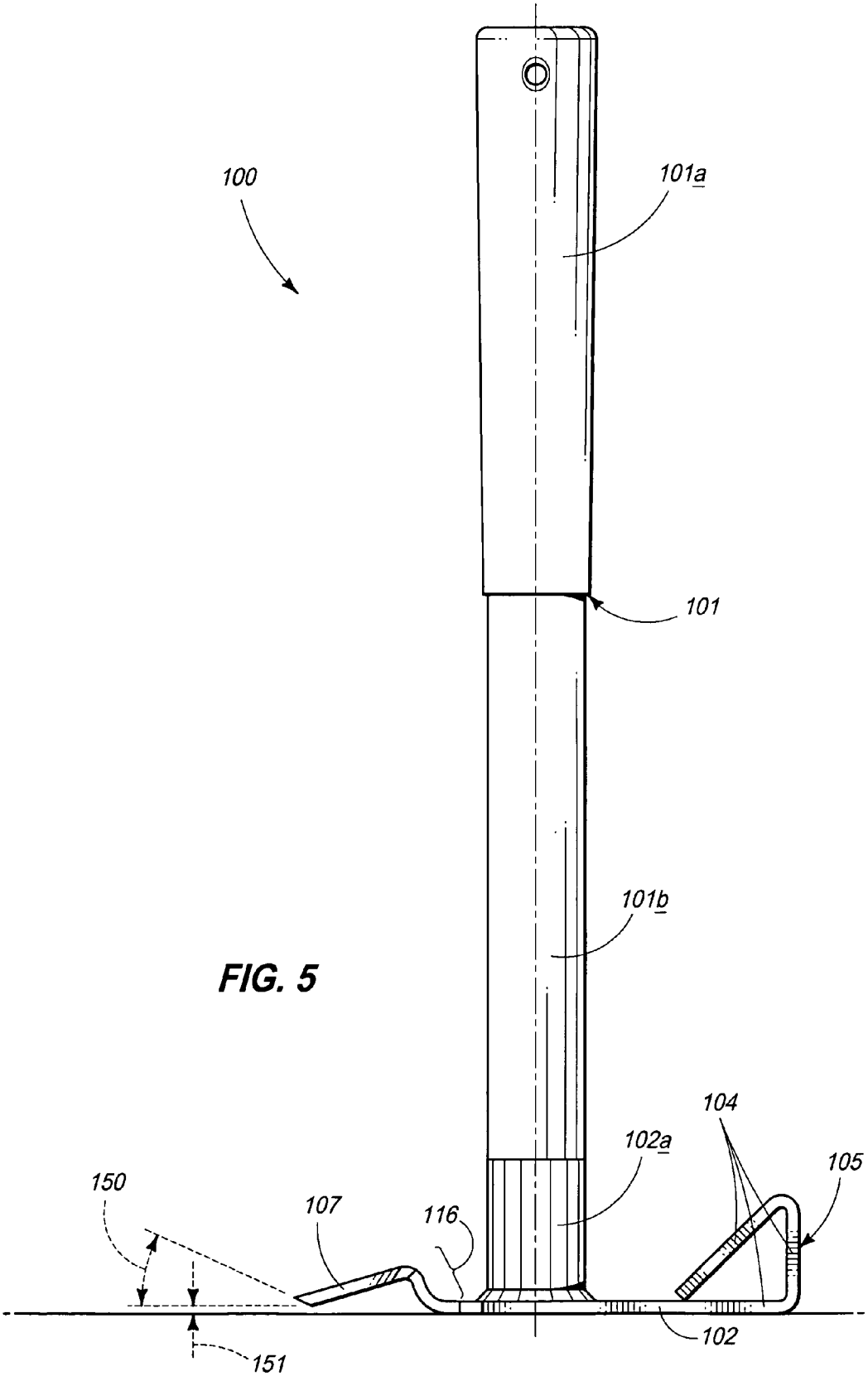
FIG. 5 is an elevation view of the example of the embodiment of the invention illustrated in FIG. 1, showing an exemplary head configuration.

FIG. 5 is an elevation view of the example of the embodiment of the invention illustrated in FIG. 1, showing an exemplary head configuration. FIG. 5 illustrates the combination tool 100, handle 101 with end portion 101*a*, head portion 101B and the shed 102, with hosel 102*a*, hammer portion 104 with hammer surface 105, scraper portion 107 and the 151 between the end of the scraper portion 107 and a surface when the head 102 is placed flat on that surface. Blade edge angle 150 is the cut angle of the edge of scraper portion 102.

Figure 6:
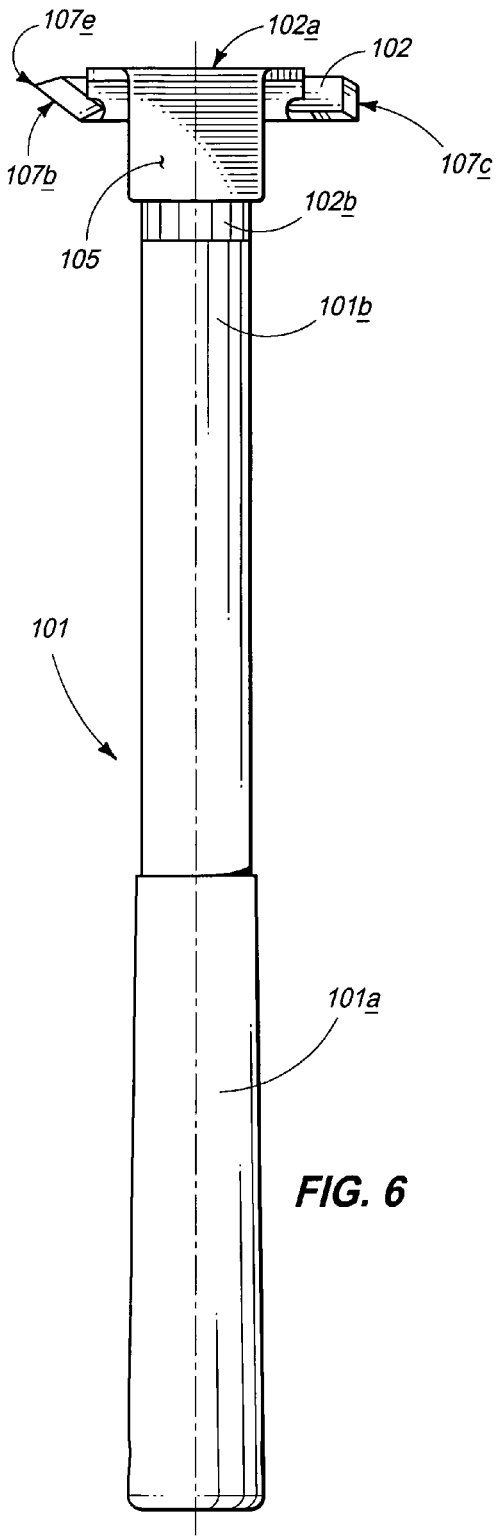
FIG. 6 is an end view of the hammer side of the example of the embodiment of the invention illustrated in FIG. 1.

FIG. 6 is an end view of the hammer side of the example of the embodiment of the invention illustrated in FIG. 1, illustrating handle 101, with end portion 101*a*, head portion 101*b*, head 102, hosel 102*b*, hammer surface 105, scraper portion 107 with first scraper side edge 107*c* and second scraper side edge 107*b*, first scraper point 107E and scraper side is 107*c*.

Figure 7:
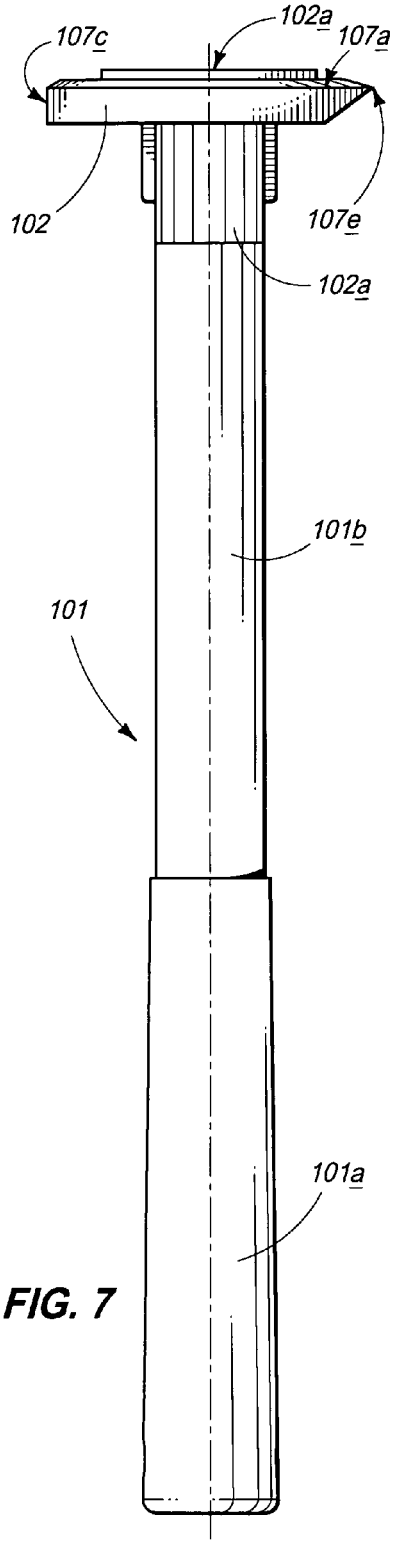
FIG. 7 is an end view of the scraper side of the example of the embodiment of the invention illustrated in FIG. 1.

FIG. 7 is an end view of the scraper side of the example of the embodiment of the invention illustrated in FIG. 1, and further illustrating scraper and of the tool. Like numbered items from and discussed relative to FIG. 6 are the same and will not be further discussed repeated here.

Figure 8:
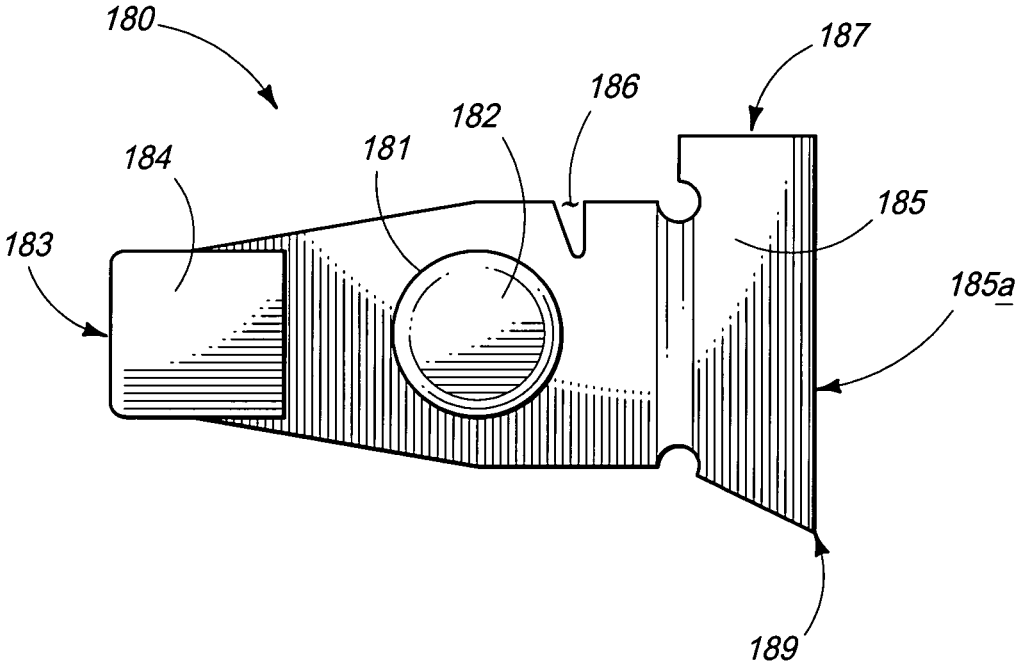
FIG. 8 is a bottom view of the scraper head example of the embodiment of the invention illustrated in FIG. 1.

FIG. 8 is a bottom view of the head of the example of the embodiment of the invention illustrated in FIG. 1, illustrating an example of an alternative embodiment wherein head 180, hosel 181, hosel aperture 182 for receiving a hosel and the handle (not shown in FIG. 8). FIG. 8 further illustrates hammer surface 183, hammer 184, nail slot 186, first scraper side 187, scraper portion 185 and scraper inch 185*a* and scraper edge 189.

Figure 9:
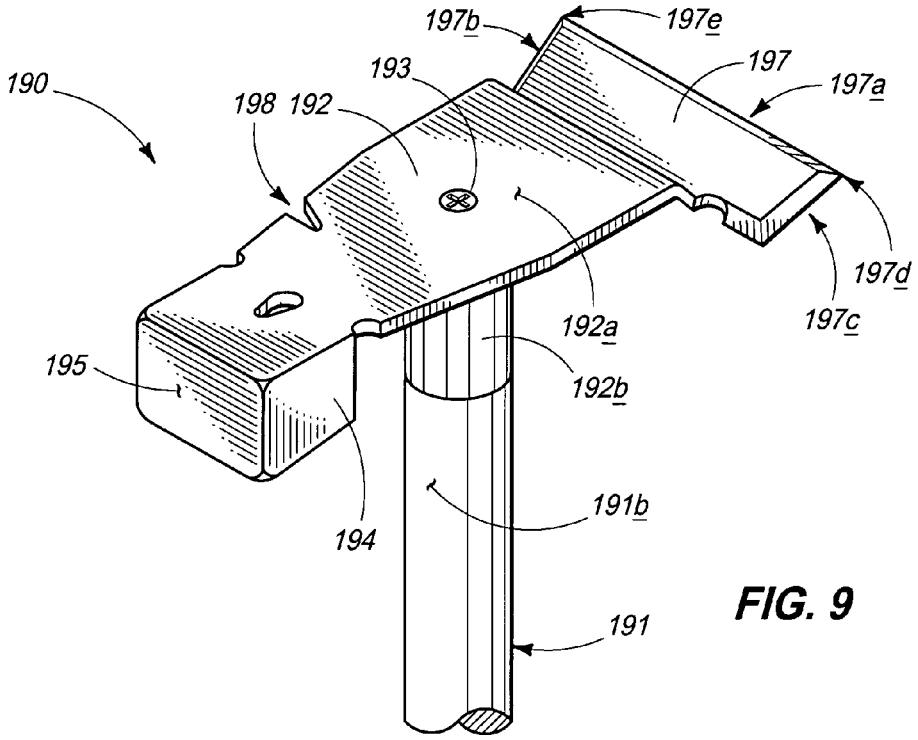
FIG. 9 is a perspective view of an example of an alternative embodiment of the invention.

FIG. 9 is a perspective view of an example of an alternative embodiment of the invention. FIG. 9 illustrates an a alternative embodiment or the hammering surface portion of the head. FIG. 9 illustrates a scraper—hammer implement 190, handle 191 with upper handle portion 191*b*, head 192, hosel 192*b*, scraper portion 197 and hammer portion 194. In this embodiment the hammer portion 194 provides hammering or hitting surface 195, but the metal is bent differently than in the embodiment shown in FIG. 1 for example, being bent in a rectangular or square configuration. Fastener 193 is fastening the head 192 to the handle 191. Nail removal aperture 198, head top surface 192*a* are shown, along with a primary or first scraping surface 197*a*, second scraping surface 197*b* and third scraping surface 197*d*, first scraping point 197*e* and second scraping point 197*d*.

Figure 10:
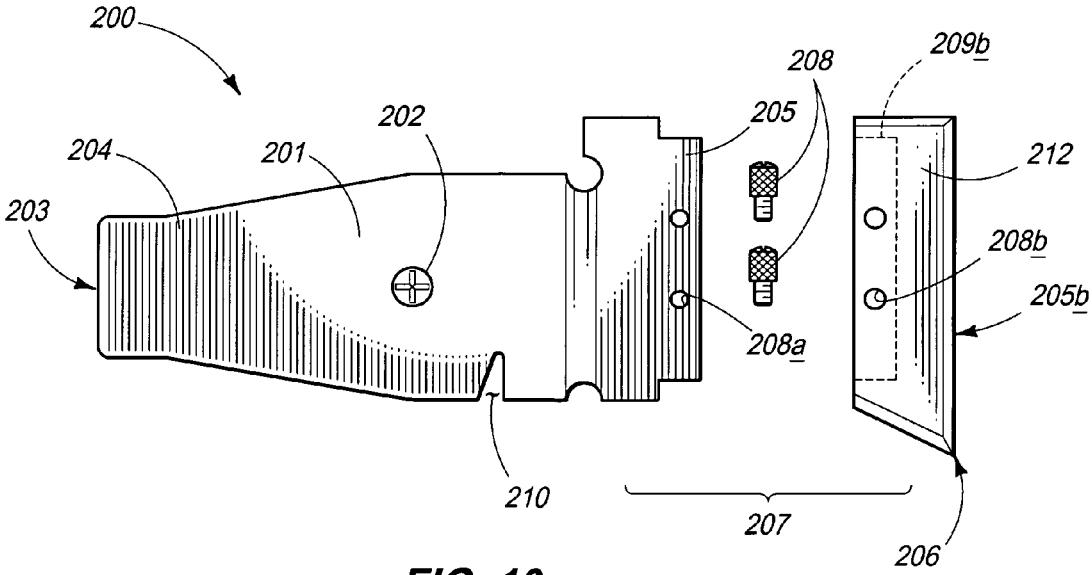
FIG. 10 is a top view of an example of another embodiment of the invention wherein the blade component of the scraper portion is replaceable.

FIG. 10 is a top view of an example of another embodiment of the invention 200 wherein the blade component of the scraper portion is replaceable. FIG. 10 illustrates head 201, fastener aperture 202 in head, hammering surface 203 (striking surface), hammer portion 204 of head 201, nail removal aperture 210, and a scraper assembly 207 at the scraper portion 212 of the head such that new scraper surfaces or blades may be installed. FIG. 10 shows scraper portion 212, fastener apertures 208*a* in the main body of the head and corresponding fastener apertures 208*b* in the replaceable scraper blade 212.

FIG. 10 further illustrates scraper portion 205 of the head 201 to which the scraper blade 212 may be fastened to then comprise a scraper portion of the implement head 201. FIG. 10 shows how a replacement scraper blade system may be used within the contemplation of this invention.

As will be appreciated by those of reasonable skill in the art, there are numerous embodiments to this invention, and variations of elements, components and combinations, which may be used, all within the scope of this invention.

One embodiment of this invention, for example, is a hand-held scraper and hammer implement, comprising: a handle with a first end and a second end, the first end being configured to be held by a human hand; a head with a top surface mounted to the second end of the handle, the head comprising: a handle mount portion; a scraper portion oriented generally transverse to the handle; a hammer portion opposite the scraper portion on the head and oriented generally transverse to the handle portion but with a hammering surface oriented generally parallel to the handle; and wherein the scraper portion includes a first scraping surface.

Further embodiments from that described in the preceding paragraph may be further: wherein the handle mount portion is a polygonal cavity configured to tightly receive the second end of the handle; wherein the polygonal cavity is generally triangular; wherein the head is configured to secure a fastener to both the handle and the head; wherein the handle mount portion is a cylindrical cavity configured to tightly receive the second end of the handle; wherein the first scraping surface is a scraping blade at a terminal end of the scraper portion, and which further comprises a second scraping blade adjacent the first scraping blade (and even further wherein the second scraping blade forms an acute angle relative to the first scraping blade and/or further comprising a third scraping blade adjacent the first scraping blade on the scraper portion of the head and on a side opposite the second scraping blade).

In still further embodiments of the invention: the head may further define a nail removal aperture; the top surface of the head is substantially flat such that the implement may be rested on the top surface; the first scraping surface may be a scraping blade at a terminal end of the scraper portion, and oriented at an upward angle relative to the top surface of the head; and/or still further wherein the scraper portion is configured to provide that the scraper blade is releasably fastened to the head such that it is attachable and detachable.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

The invention claimed is:

1. A hand-held scraper and hammer implement, comprising:

a handle with a first end and a second end, the first end being configured to be held by a human hand;

a head with a top surface mounted to the second end of the handle, the head comprising:

a handle mount portion;

a scraper portion oriented generally transverse to the handle;

a hammer portion opposite the scraper portion on the head and oriented generally transverse to the handle portion but with a hammering surface oriented generally parallel to the handle; and wherein the scraper portion includes a first scraping surface oriented generally transverse to the handle portion; and further wherein the to surface of the head defines a nail removal slot.

2. A hand-held scraper and hammer implement as recited in claim 1, and further wherein the handle mount portion is a polygonal cavity configured to tightly receive the second end of the handle.

3. A hand-held scraper and hammer implement as recited in claim 1, and further wherein the polygonal cavity is generally triangular.

4. A hand-held scraper and hammer implement as recited in claim 1, and further wherein the head is configured to secure a fastener to both the handle and the head.

5. A hand-held scraper and hammer implement as recited in claim 1, and further wherein the handle mount portion is a cylindrical cavity configured to tightly receive the second end of the handle.

6. A hand-held scraper and hammer implement as recited in claim 1, and wherein the first scraping surface is a scraping blade at a terminal end of the scraper portion, and which further comprises a second scraping blade adjacent the first scraping blade.

7. A hand-held scraper and hammer implement as recited in claim 6, and further wherein the second scraping blade forms an acute angle relative to the first scraping blade.

8. A hand-held scraper and hammer implement as recited in claim 7, and further comprising a third scraping blade adjacent the first scraping blade on the scraper portion of the head and on a side opposite the second scraping blade.

9. A hand-held scraper and hammer implement as recited in claim 8, and wherein the head further defines a nail removal aperture.

10. A hand-held scraper and hammer implement as recited in claim 9, and further wherein the head is further configured such that when the implement is resting on the top surface, the scraping blade is offset from the top surface such that it does not come into contact with a surface upon which the implement is resting.

11. A hand-held scraper and hammer implement as recited in claim 1, and further wherein the top surface of the head is substantially flat such that the implement may be rested on the top surface.

12. A hand-held scraper and hammer implement as recited in claim 1, and wherein the first scraping surface is a scraping blade at a terminal end of the scraper portion, and oriented at an upward angle relative to the top surface of the head.

13. A hand-held scraper and hammer implement as recited in claim 1, and further wherein the scraper portion is configured to provide that the scraper blade is releasably fastened to the head such that it is attachable and detachable.

* * * * *